US007363672B2

(12) United States Patent
Hawksworth

(10) Patent No.: US 7,363,672 B2
(45) Date of Patent: Apr. 29, 2008

(54) PERFORMANCE ENHANCING AUTOMATIC POOL CLEANER ACCESSORY

(76) Inventor: Kenneth Lewis Hawksworth, 23 Truter Street, Parkdene, Boksburg, 1459 Gauteng Province (ZA)

( * ) Notice: Subject to any disclaimer, the term of this patent is extended or adjusted under 35 U.S.C. 154(b) by 317 days.

(21) Appl. No.: 10/451,562

(22) PCT Filed: Dec. 20, 2001

(86) PCT No.: PCT/ZA01/00209

§ 371 (c)(1),
(2), (4) Date: Jun. 20, 2003

(87) PCT Pub. No.: WO02/50390

PCT Pub. Date: Jun. 27, 2002

(65) Prior Publication Data

US 2004/0049866 A1 Mar. 18, 2004

(30) Foreign Application Priority Data

Dec. 21, 2000 (ZA) ..... 2000/7733

(51) Int. Cl.
*E04H 4/16* (2006.01)

(52) U.S. Cl. ..... 15/1.7; 15/246; 285/261; 285/263; 285/272

(58) Field of Classification Search ..... None
See application file for complete search history.

(56) References Cited

U.S. PATENT DOCUMENTS 5,775,741 A 7/1998 Rice et al.

FOREIGN PATENT DOCUMENTS

WO WO-98/51888 A1 11/1998
WO WO-00/45080 A1 8/2000

*Primary Examiner*—David A Redding
(74) *Attorney, Agent, or Firm*—Meyertons, Hood, Kivlin, Kowert & Goetzel, P.C.; Eric B. Meyertons

(57) ABSTRACT

An automatic pool cleaner accessory is provided comprising a tubular assembly (6) for connection to, or for inclusion in, a pool cleaner suction hose (4). The tubular assembly includes first and second tubular members (8, 9) generally coaxial with each other and freely relatively rotatable about a common axis in an inoperative condition of the accessory. Means (16) are provided for inhibiting relative rotation of the members in the operative condition with suction applied to the interior thereof. The accessory is preferably used in combination with a connector tube (7) for installation in a suction hose assembly, the connector tube comprising a central portion (21) of substantially rigid tube having at one end a first terminal portion (22) with its axis extending at an incline to that of the straight central portion, and at the other end a second terminal portion (23) having its axis likewise extending at an incline to the axis of the straight central portion. In end view taken along the axis of the central portion, the axis of the first terminal portion diverges from the axis of the second terminal portion.

11 Claims, 4 Drawing Sheets

PERFORMANCE ENHANCING AUTOMATIC POOL CLEANER ACCESSORY

FIELD OF THE INVENTION

This invention relates to a performance enhancing accessory for use in combination with an automatic swimming pool cleaner of the general type designed to move in a substantially random manner over the floor and walls of a swimming pool in order to clean same. More particularly, the invention is concerned with an accessory that enhances the randomness of the movement of the swimming pool cleaner over the surface to be cleaned, in particular, by countering the general tendency of such cleaners to follow general broad patterns which can tend to leave out certain areas of the pool surface.

Whilst the following description will be directed primarily at swimming pool cleaners, it will be understood that the invention is intended to apply in its scope to automatic pool cleaners used to clean any other pool of liquid.

BACKGROUND TO THE INVENTION

There is a wide variety of different automatic swimming pool cleaners in use at the present time. Most of them are intended, and indeed designed, to move freely and randomly over the floor and wall surface of a pool in order to clean the entire surface area although there have been some designs in which a steering mechanism has been included with a view to modifying the uncontrolled random movement in order to make it more effective.

Nevertheless, for the most part, existing pool cleaners do not cover the entire surface area and patches, amounting quite commonly up to 30% of the surface area, are not covered by the pool cleaner during its supposedly "random" movement as a result of the fact that general patterns of movement tend to develop.

Numerous different reasons have been put forward to explain this failure. These include the fact that many pool cleaners become trapped against some or other formation in a swimming pool; the hose characteristics vary quite significantly and indeed hose sections can take on a particular crooked configuration in consequence of temperature fluctuations and physical forces that have been applied to the individual hose sections; the effective length of the hose may be incorrect and the hose may be too long or too short; and each different design of swimming pool and the location of the point of connection of the suction hose to the filtration assembly inhibits the swimming pool cleaner to a different extent and in different ways from reaching all regions of the surface.

A common partial cure that is recommended is to take the hose out of the pool; stretch it out in a straight line; and leave it in the sun for a time sufficient to enable it to totally relieve stresses in the plastic material from which it is made. Thereafter the hose should be cooled rapidly in the straight condition. This sometimes has a beneficial effect but by no means overcomes certain limitations that are inherent in some swimming pool installations and it also does not prevent the problem from recurring.

OBJECT OF THE INVENTION

It is an object of this invention to provide an accessory that is aimed at diminishing the difficulty described above and in consequence enhancing the performance of many different types of automatic swimming pool cleaners.

SUMMARY OF THE INVENTION

In accordance with a first aspect of this invention there is provided an automatic pool cleaner accessory comprising a tubular assembly for connection to, or for inclusion in, a pool cleaner suction hose, the tubular assembly including first and second tubular members generally coaxial with each other and being freely relatively rotatable about a common axis in an inoperative condition of the accessory, and means for inhibiting relative rotation of the members in the operative condition with suction applied to the interior thereof.

Further features of this aspect of the invention provide for the first tubular member to have an end region and associated inner end received captively, but relatively rotatably, in a tubular skirt portion of the second tubular is member; for the second tubular member to have a friction affording sealing ring for engagement by the said inner end of the first tubular member under conditions of suction being applied; for each tubular member to carry at its free end a spigot or socket formation for connection to a socket or spigot end of a conventional length of suction hose or, alternatively, to a plain end of a conventional length of suction hose; for the tubular skirt portion of the second tubular member to have one or more perforations through the skirt wall adjacent the seal; and for the inner end region of the first tubular member that is received in the tubular skirt portion of the second tubular member to have a ridge extending circumferentially in its outer surface with such inner end being held captively within the second tubular member, for example by an inwardly directed circumferential ridge on the inner surface of the said second tubular member.

In accordance with a second aspect of the invention there is provided a connector tube for installation in a suction hose assembly, the connector tube comprising a central portion of substantially rigid tube having a generally longitudinally extending axis associated therewith, a first terminal portion at one end of the central portion and having its axis extending at an incline to the longitudinally extending axis associated with the central portion, and a second terminal portion at the other end of the central portion and having its axis likewise extending at an incline to the longitudinally extending axis associated with the central portion, the connector tube being characterized in that, in end view taken along the said longitudinally extending axis associated with the central portion, the axis of the first terminal portion diverges from the axis of the second terminal portion.

Further features of this aspect of the invention provide for the central portion to be a short straight portion; for the central portion and each of the two terminal portions to have approximately the same length, conveniently of the order of 20 to 50 mm; for the one terminal portion to terminate in a spigot or socket formation for connection to a socket or spigot of a conventional suction hose assembly whilst the second terminal portion may either terminate in the other of such a socket or spigot for connection to a spigot or socket of an automatic pool cleaner head or be integral with a part, generally a rotatable part, of an automatic pool cleaner head; for the axis of the first terminal portion to make an angle with the longitudinally extending axis of the central portion of from about 5 to about 30 degrees, preferably from about 8 to about 20 degrees, and most preferably about 12 degrees; for the axis of the second terminal portion to make an angle with the longitudinally extending axis of the central portion of from about 10 to about 60 degrees, preferably from about 20 to about 40 degrees, and most preferably about 28 degrees; and for the plane containing both the longitudinally extending axis of the central portion and the axis of the first terminal portion to make an angle of between about 60 and about 75 degrees and preferably about 68 degrees with the plane containing both the longitudinally extending axis of the central portion and the axis of the second terminal portion.

Preferably, both aspects of the invention are included in a suction hose assembly with the tubular assembly being connected between the ends of two contiguous lengths of suction hose towards the end of the suction hose remote from the suction head, preferably where movement of the hose is minimal and accordingly generally near the point where the hose is connected to a suction inlet. The connecting tube is preferably installed between the suction head and the suction hose with said first terminal portion being connected to the hose and said second terminal portion being connected to the suction head.

In order that the invention may be more fully understood one embodiment of each aspect thereof will now be described with reference to the accompanying drawings.

DETAILED DESCRIPTION WITH REFERENCE TO THE DRAWINGS

Figure 1:
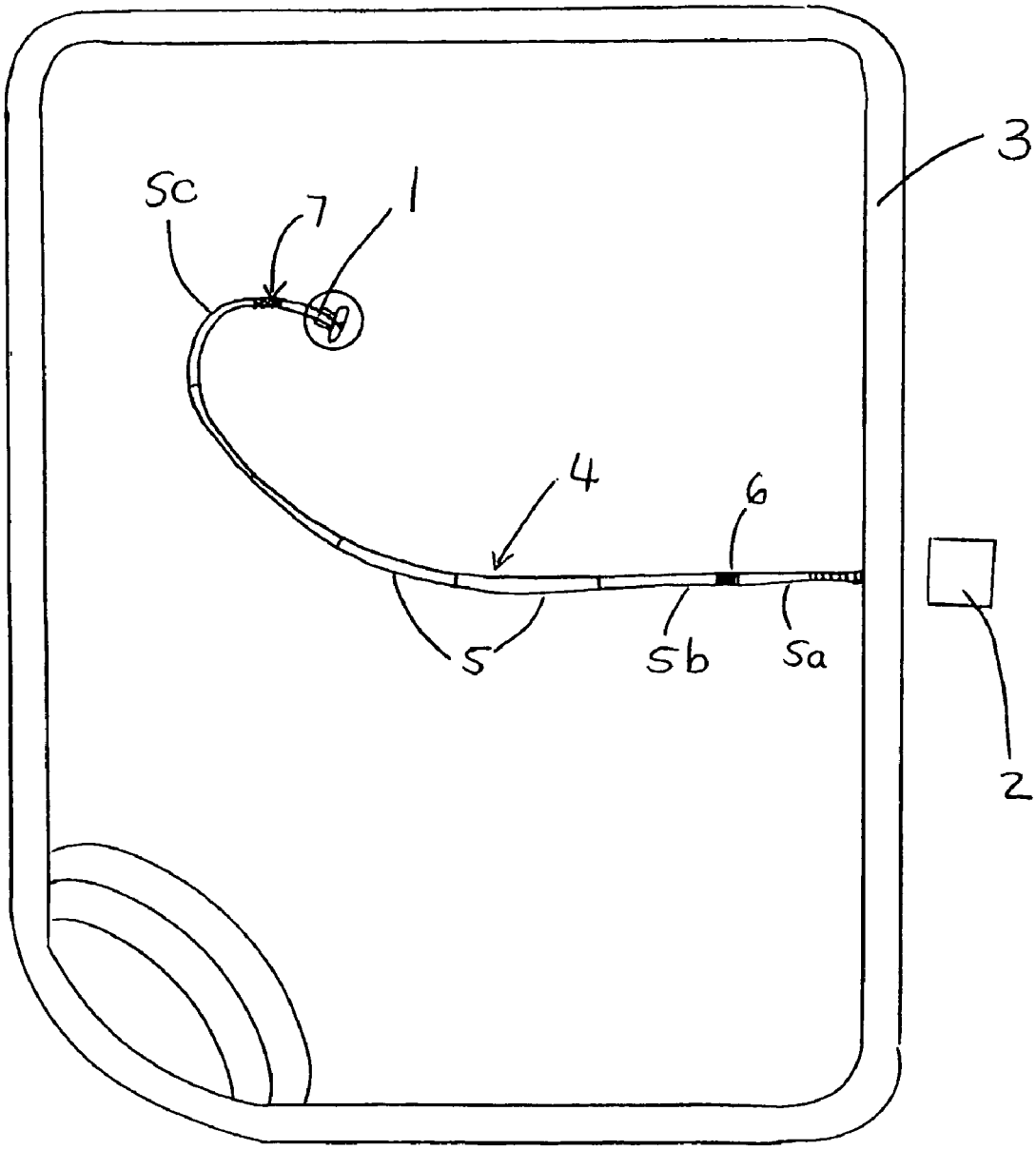
FIG. 1 is a plan view of a swimming pool employing an automatic pool cleaner fitted with both aspects of the accessory of the invention.

The accessory of this invention is adapted to be applied to any automatic swimming pool cleaner such as is illustrated in FIG. 1 and wherein an automatic pool cleaner suction head (1) is connected to the suction side of a filtration pump (not shown) usually by way of an inlet in a weir (2) positioned at the side of a swimming pool (3) by way of a suction hose generally indicated by numeral (4). The suction hose is made up of a series of contiguous lengths (5) of suction hose whereof each length has a spigot connector at one end and a socket connector at the opposite end. This arrangement enables a series of lengths to be connected together to provide a hose of the required overall length. Typically the hose will be of the type which has a helically extending rib on the outside thereof.

The accessory of the invention is applied to such an installation by installing a tubular assembly generally indicated by numeral (6) and constituting the first aspect of the invention between the spigot of one length of suction hose and the socket on the next contiguous length of suction hose. This is preferably effected at a position removed from the suction head (1) and, in the illustrated situation, between the hose length (5*a*) connected to the weir and the next adjacent hose length (5*b*). In the event that an in-line leaf trap is included in the hose, this should be located between the tubular assembly and the suction inlet at the end of the suction hose remote from the pool cleaner head.

The connector tube which constitutes the second aspect of the invention and which is generally indicated by numeral (7) is connected between the suction head (1) and the hose length (5*c*) furthest from the weir.

Figure 2:
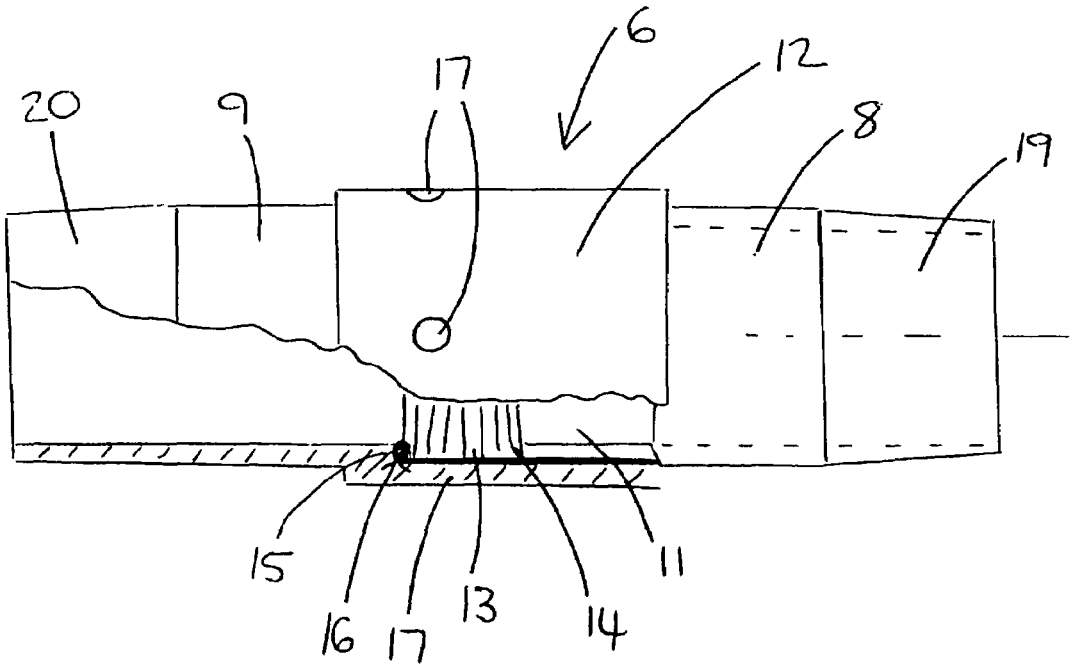
FIG. 2 is a partly sectioned elevation of a tubular assembly according to the first aspect of the invention.

Referring now more particularly to FIG. 2, the tubular assembly constituting lo the first aspect of the invention comprises two substantially coaxial tubular plastics members (8) and (9). The first tubular member (8) has its one end region (11) received in an enlarged skirt end (12) of the second tubular member (9). The end region (11) of the first tubular member has a ridge (13) in its outer surface which Co.-operates within an internally directed ridge (14) 15 formed on the inside of the second tubular member (9) so that the first tubular member is held captive relative to the second tubular member but is freely rotatable relative to the second tubular member about the common axis.

The second tubular member has a shoulder (15) at the inner end of the enlarged skirt end (12) into which the end region (11) of the first tubular member extends and the exposed surface of the shoulder is defined by a sealing ring (16) that is in line with the periphery of the inner end of the first tubular member. The sealing ring is thus coaxial with the two tubular members and is adapted to cooperate with the periphery of the inner end of the first tubular member to form a seal when suction is applied to the interior of the assembly.

A plurality of holes (17) is provided through the wall of the enlarged end (12) adjacent the sealing ring so that water can enter through these holes and flush the sealing ring each time suction is applied or released. Furthermore, these holes avoid the creation of a flow of water in through the rather narrow space between the inner surface of the enlarged end of the second tubular member and the adjacent outer surface of the inner end of the first tubular member and avoids dirt being drawn into the rather small space between these two surfaces. It will be understood that the skirt serves as a guide and a retainer for the first tubular member.

The one tubular member (8) has the outer surface at its free end formed into a conical spigot (19) complementary to a socket on a hose length and the end of the other tubular member may be formed into another spigot (20) or alternatively a socket similarly complementary to the conical spigots and sockets on the ends of suction hose lengths. Two spigots are used presently in order to facilitate initial production but ultimately a spigot and socket will be employed as this enables the assembly to be easily fitted into a suction hose at a joint between two hose lengths.

This arrangement is such that the one tubular member can rotate freely relative to the other tubular member when the assembly is inoperative. When, however, the assembly is operative, and a suction is applied to the interior thereof, the suction causes the periphery of the inner end of the first tubular member to move into engagement with the sealing ring and this has the effect of inhibiting the free rotation. A frictional braking force is thus generated either preventing or otherwise inhibiting relative rotation of these two tubular members. Thus, the sealing ring, in engagement with the first tubular member, provides one embodiment of a means for inhibiting rotation of the members in the operative condition.

Accordingly, after each time the swimming pool filter is turned off, the adjacent lengths of suction hose can rotate freely relative to each other which they generally do and cause the relative angular positions of the two lengths of hose connected by the tubular assembly to change. This causes the pool cleaner head to adopt a different path of movement the next time the swimming pool filter is turned on and suction is applied to the hose. This feature, when used in combination with the connector tube described below, is particularly advantageous as will become apparent from the following.

Figure 7:
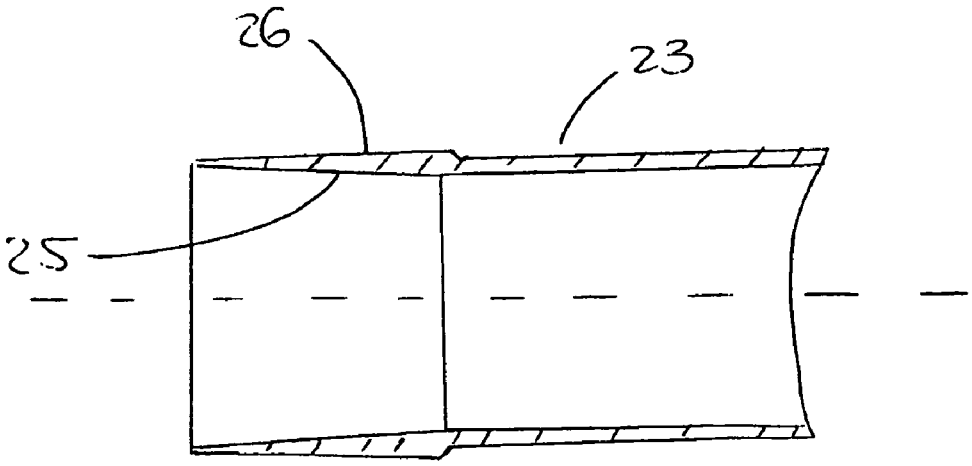

Turning now to the second aspect of the invention, and referring more particularly to FIGS. 3 to 6 of the drawings, the connector tube (7) has a central straight portion (21) and a first terminal portion (22) and a second terminal portion (23) at its two ends. The axes (22*a* and 23*a*) of the terminal 5 portions each extend at an inclination to the axis (21*a*) of the central portion as indicated by angles "A" and "B" in FIGS. 5 and 4 respectively. These angles are, in this embodiment of the invention, about 12 and 28 degrees. The first terminal portion (22) ends in a complementary spigot whilst the second terminal portion. (23) ends in a combination spigot and socket that is illustrated in FIG. 7. The combination spigot and socket, has an inner tapered surface (25) compatible with certain types of suction heads of automatic swimming pool cleaners and an outer tapered surface (26) that is compatible with certain other types of suction heads.

The axes of the two terminal portions are not coplanar. For ease of explanation line V-V in FIG. 6 can be considered to be a plane in which the axes of the central portion (21) and the first terminal portion (22) both lie (the real inclination between the two being indicated as angle "A" in FIG. 5) and line IV-IV can be considered to be a plane in which the axes of the central portion and the second terminal portion (23) both lie (the real inclination between the two being indicated as angle "B" in FIG. 4). These two planes make an angle "C" with each other as shown clearly in FIG. 6 and this angle is, in this embodiment of the invention, about 68 degrees.

Figure 3:
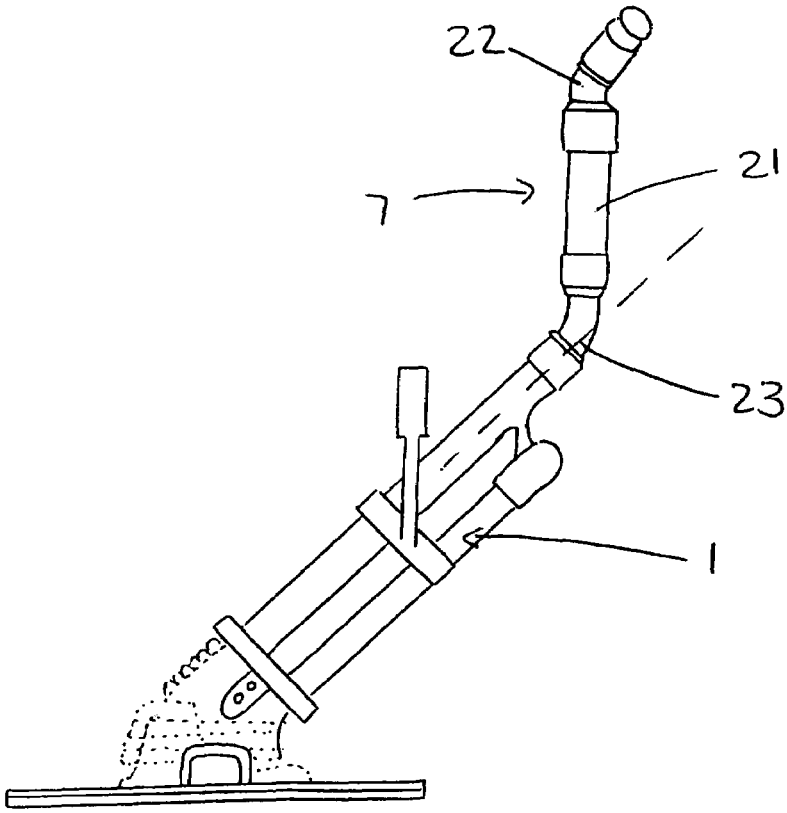
FIG. 3 is an elevation of an automatic pool cleaner head fitted with a connector tube according to the second aspect of the invention.
Figure 4:
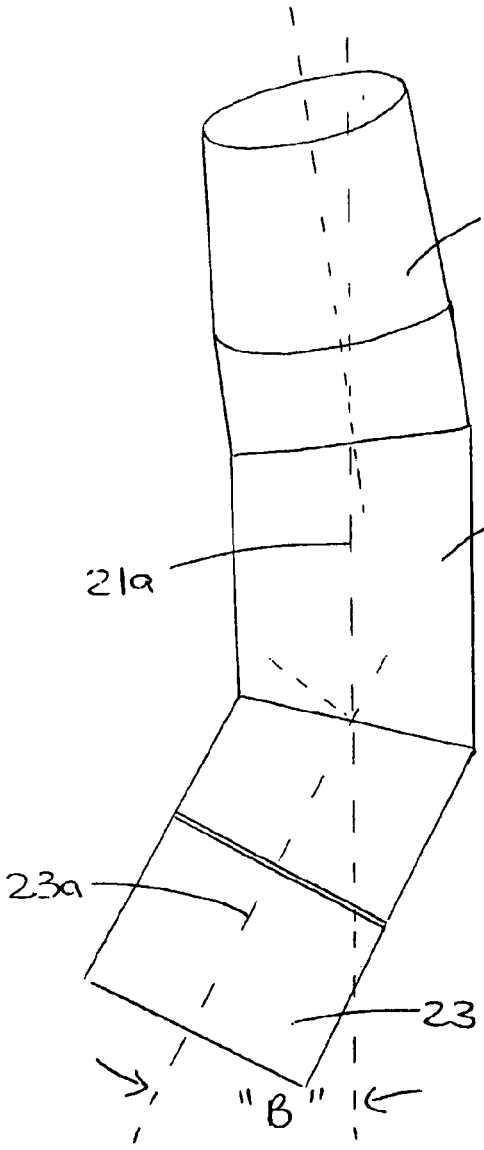
FIG. 4 is an elevation of the connector tube alone taken in the direction indicated by line IV-IV in FIG. 6.
Figure 5:
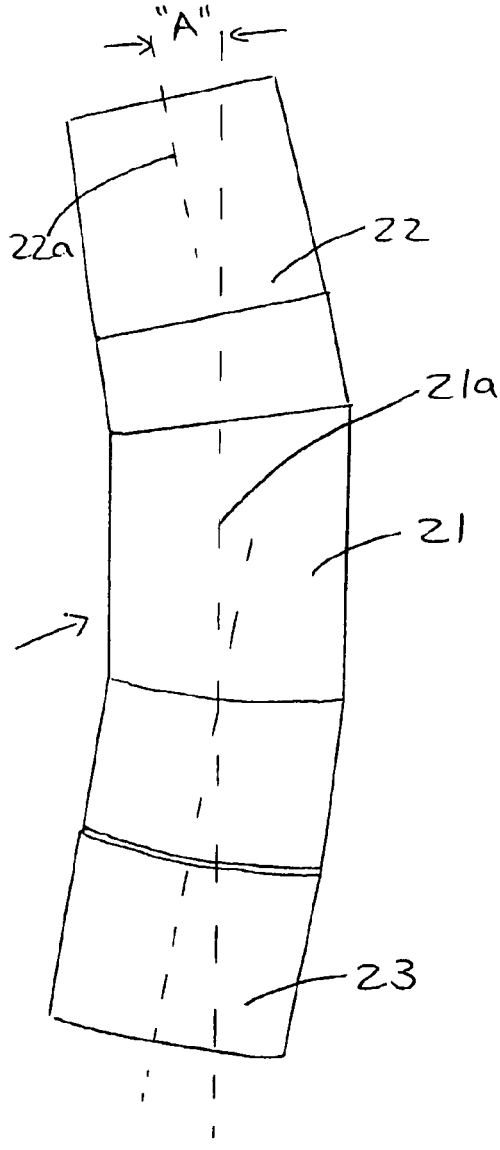
FIG. 5 is an elevation of the connector tube alone taken in the direction indicated by line V-V in FIG. 6.
Figure 6:
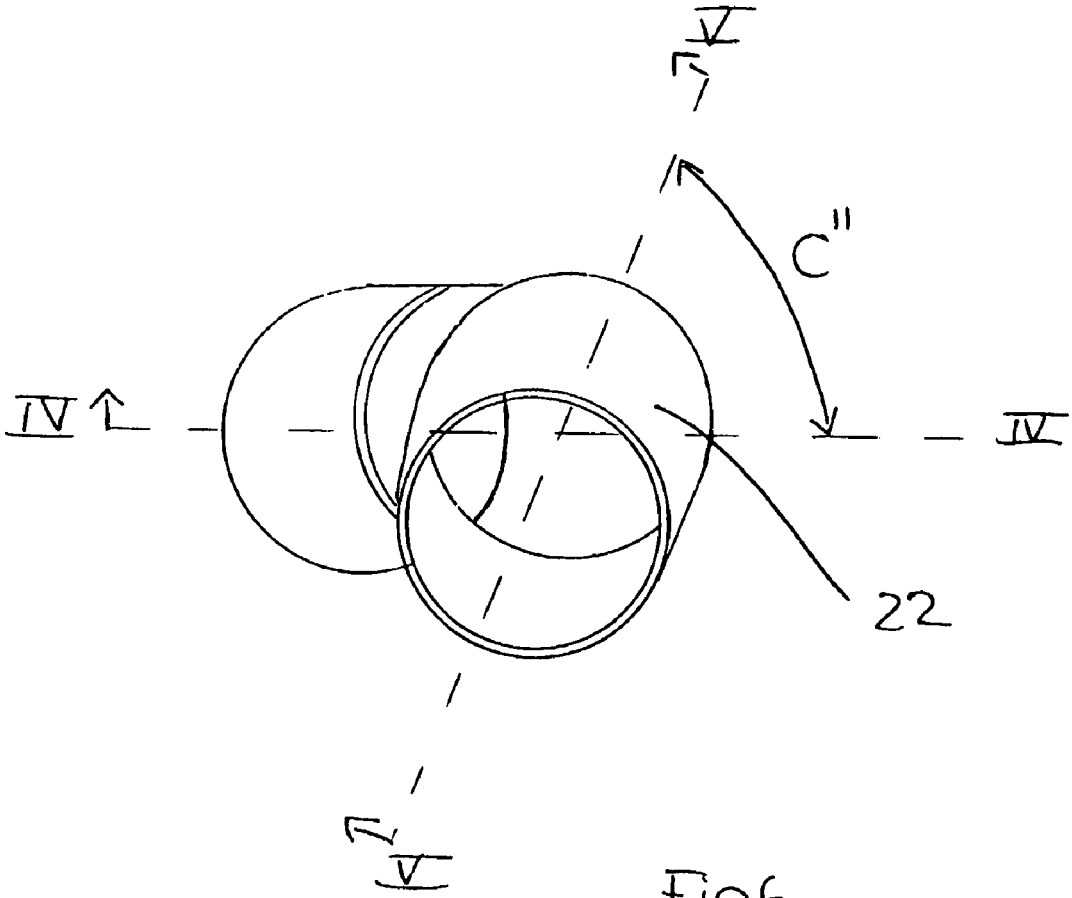
FIG. 6 is an end view of the connector tube showing the angular offset between the axes of the two terminal portions thereof; and, FIG. 7 is a sectional detail illustrating a combination spigot and socket provided on the second terminal portion.

The connector tube normally has the second terminal portion attached directly to the pool cleaner head as shown in FIG. 3 and is attached to the usual rotatable spigot or socket associated with the suction head. The opposite end, that is to say the first terminal portion of the connector tube is attached to the suction hose.

It has been found that, in use, the connector tube is highly effective in assisting in steering the suction head in a random manner and, more particularly, out of difficult situations. This is believed to be due to th fact that the tubular assembly operates to vary the angular positions of the two hose lengths between which it is located each time the filtration plant is turned on and off and thus suction is applied and removed. In the case of a hose with a helical rib the contraction resulting from the application of suction each time it is applied causes rotation of the end of the hose attached to the connector tube, and, accordingly, rotation of the connector tube. Of course, using different hose lengths having a different hand of helical rib would negate this effect.

The asymmetric configuration of the connector tube thus results in a different path being followed by the suction head. Each time the suction is removed the two tubular members become disengaged and can rotate freely as the hose relaxes from its contracted condition. The connector tube is thus not rotated at this stage but is only rotated once more when suction is next applied to the hose. A general progressive step by step rotation of the connector tube in one direction therefore results as the suction is applied and removed. The random movement of the suction head and the overall cleaning efficiency thereof is thus substantially enhanced.

Clearly, many variations may be made to the embodiment of the invention described above without departing from the scope hereof. In particular, the various angles mentioned can be varied widely as can the construction of both of the different aspects of the invention. Also, the tubular assembly could be embodied permanently in a hose end or the connector tube, for example.

More particularly, regarding the tubular assembly, the sealing ring may assume many different forms and may have many different types of surface characteristics. It may be that the sealing ring is not adapted to absolutely prevent relative rotation of the two tubular members under conditions of suction but a very much restricted or, indeed, only slightly restricted rotation of the two relative to each other could be permitted. It is also envisaged that formations could be embodied in the two tubular members so that rotation of one relative to the other is permitted in one direction only.

The invention claimed is:

1. An automatic pool cleaner accessory comprising a tubular assembly for connection to, or for inclusion in, a pool cleaner suction hose, wherein the tubular assembly includes first and second tubular members generally coaxial with each other; wherein the first and second tubular members are freely relatively rotatable about a common axis in an inoperative condition of the accessory; and means are provided for inhibiting relative rotation of the members in the operative condition with suction applied to the interior thereof.

2. An automatic pool cleaner accessory as claimed in claim 1 in which the first tubular member has an end region and associated inner end received captively, and relatively rotatably, in a tubular skirt portion of the second tubular member.

3. An automatic pool cleaner accessory as claimed in claim 2 in which the second tubular member has a friction affording sealing ring for engagement by the said inner end of the first tubular member under conditions of suction being applied to the interior thereof.

4. An automatic pool cleaner accessory as claimed in claim 1 in which each tubular member carries at its free end a spigot or socket formation for connection to any one of a socket end, a spigot end, or a plain end of a conventional length of suction hose.

5. An automatic pool cleaner accessory as claimed in claim 3 in which a tubular skirt portion of the second tubular member has one or more perforations through the skirt wall adjacent the seal.

6. An automatic pool cleaner accessory as claimed in claim 2 in which an inner end region of the first tubular member that is received in a tubular skirt portion of the second tubular member has a ridge extending circumferentially on its outer surface with such inner end being held captively within the second tubular member by an inwardly directed circumferential ridge on the inner surface of the said second tubular member.

7. A suction hose assembly comprising a tubular assembly as claimed in claim 1, two contiguous lengths of suction hose one of which has an end associated with a suction head and an end remote from the suction head, and a connecting tube wherein the tubular assembly is connected between said end remote from the suction head of the one suction hose and an end of the other suction hose wherein the connecting tube is installed between the suction head and the associated suction hose, wherein the connector tube comprises a central portion of substantially rigid tube having a generally longitudinally extending axis associated therewith, a first terminal portion at one end of the central portion and having its axis extending at an incline to the longitudinally extending axis associated with the central portion, and a second terminal portion at the other end of the central portion and having its axis likewise extending at an incline to the longitudinally extending axis associated with the central portion, and wherein, in end view taken along the said longitudinally extending axis associated with the central portion, the axis of the first terminal portion diverges from the axis of the second terminal portion.

8. A suction hose assembly as claimed in claim 7 in which the central portion and each of the two terminal portions have approximately the same length.

9. A suction hose assembly as claimed in claim 7 in which the one terminal portion terminates in a spigot or socket formation for connection to a socket or spigot of a conventional suction hose assembly whilst the second terminal portion may either terminate in the other of such a socket or spigot for connection to a spigot or socket of an automatic pool cleaner head or be integral with a part of the automatic pool cleaner head.

10. A suction hose assembly as claimed in claim 7 in which the axis of the first terminal portion makes an angle with the longitudinally extending axis of the central portion of from about 5 to about 30 degrees; the axis of the second terminal portion makes an angle with the longitudinally extending axis of the central portion of from about 10 to about 60 degrees; and the plane containing both the longitudinally extending axis of the central portion and the axis of the first terminal portion makes an angle of between about 60 and about 75 degrees with the plane containing both the longitudinally extending axis of the central portion and the axis of the second terminal portion.

11. A suction hose assembly as claimed in claim 10 in which the axis of the first terminal portion makes an angle with the longitudinally extending axis of the central portion of from about 8 to about 20 degrees; and the axis of the second terminal portion makes an angle with the longitudinally extending axis of the central portion of from about 20 to about 40 degrees.

* * * * *